US009777725B2

(12) United States Patent
Liu et al.

(10) Patent No.: US 9,777,725 B2
(45) Date of Patent: Oct. 3, 2017

(54) HIGH PRESSURE WATER PUMP

(71) Applicant: Taizhou Dajiang Ind. Co., Ltd., Wenling, Zhejiang Province (CN)

(72) Inventors: Gui-Wen Liu, Wenling (CN); Ming-Jun Yang, Wenling (CN); Jin-Quan Huang, Wenling (CN)

(73) Assignee: TAIZHOU DAJIANG IND. CO., LTD., Wenling, Zhejiang Province (CN)

( * ) Notice: Subject to any disclaimer, the term of this patent is extended or adjusted under 35 U.S.C. 154(b) by 564 days.

(21) Appl. No.: 14/550,649

(22) Filed: Nov. 21, 2014

(65) Prior Publication Data

US 2016/0023339 A1 Jan. 28, 2016

(30) Foreign Application Priority Data

Jul. 24, 2014 (CN) ..... 2014 1 0354531
Jul. 24, 2014 (CN) ..... 2014 2 0411665 U

(51) Int. Cl.
*B25C 1/04* (2006.01)
*B25C 5/02* (2006.01)
(Continued)

(52) U.S. Cl.
CPC ..... *F04B 49/22* (2013.01); *F04B 37/12* (2013.01); *F04B 39/08* (2013.01); *F04B 49/12* (2013.01); *F04B 53/10* (2013.01); *F04B 53/16* (2013.01)

(58) Field of Classification Search
CPC B25C 1/04; B25C 1/041; B25C 1/048; B25C 1/00; B25C 1/047; B25C 1/08;
(Continued)

(56) References Cited

U.S. PATENT DOCUMENTS 2,755,783 A * 7/1956 Kupka ..... E02D 7/12 123/46 R
2,987,047 A * 6/1961 Young ..... F01L 23/00 417/398
(Continued)

FOREIGN PATENT DOCUMENTS

CN 2237737 Y 10/1996
CN 101532481 A 9/2009
(Continued)

OTHER PUBLICATIONS

International Search Report issued by the State Intellectual Property Office of the Peoples Republic of China dated Sep. 30, 2015 for PCT/CN2015/082161.

*Primary Examiner* — Robert Long
(74) *Attorney, Agent, or Firm* — Tim Tingkang Xia, Esq.; Locke Lord LLP

(57) ABSTRACT

The invention relates to a high pressure water pump and a steam powered nailing gun having the high pressure water pump. In certain embodiments, high pressure water pump includes: an upper pump body, a lower pump body, a water discharge valve, a water intake valve, a plunger, a guide sleeve, a hammering cap, an adjustment knob, and an evacuation valve. Both upper and lower pump body are connected by connecting bolts. A sealing ring is disposed between upper and lower pump body and a sealing element is disposed between the upper pump body and plunger. Plunger is sheathed in upper pump body. The hammering cap is threadedly connected to the plunger. The adjustment knob is connected to an upper end of upper pump body. The hammering cap is moveably connected to the adjustment knob through the plunger. A plunger reset spring is disposed between hammering cap and adjustment knob.

20 Claims, 8 Drawing Sheets

(51) Int. Cl.

| | |
|---|---|
| ***B25C 5/06*** | (2006.01) |
| ***F04B 49/22*** | (2006.01) |
| ***F04B 49/12*** | (2006.01) |
| ***F04B 39/08*** | (2006.01) |
| ***F04B 37/12*** | (2006.01) |
| ***F04B 53/10*** | (2006.01) |
| ***F04B 53/16*** | (2006.01) |

(58) Field of Classification Search

CPC .. B25C 1/008; B25C 1/05; B25C 5/16; B25C 5/1627; F04B 23/02; F04B 53/16; F04B 39/08; F04B 49/12; F04B 49/22

USPC ..... 227/107–139, 2, 4, 8, 10, 140, 142, 227/147–148; 173/114, 168, 169, 206, 173/208; 91/309, 317, 325, 342; 123/46 SC, 46 R

See application file for complete search history.

(56) References Cited

U.S. PATENT DOCUMENTS 3,556,692 A * 1/1971 Pigott et al. ..... F04B 11/0016 417/540
3,721,095 A * 3/1973 Chelminski ..... E02D 7/00 173/1
3,803,840 A * 4/1974 Toczycki ..... B25C 1/00 227/130
3,952,398 A * 4/1976 Haytayan ..... B25C 1/041 227/130
3,967,771 A * 7/1976 Smith ..... B25C 1/08 227/10
4,040,164 A * 8/1977 Briles ..... B25C 1/04 227/130
4,638,870 A * 1/1987 Kousek ..... B25F 5/00 173/183
4,688,645 A * 8/1987 Muller ..... B25C 1/04 173/13
4,739,915 A * 4/1988 Cotta ..... B25C 1/08 123/46 SC
4,811,881 A * 3/1989 Heck ..... B21J 15/105 227/112
5,462,042 A * 10/1995 Greenwell ..... F41B 11/62 124/56
6,102,133 A * 8/2000 Scheid ..... E02D 7/26 173/1
6,371,348 B1 * 4/2002 Canlas ..... B25C 1/008 123/46 SC
7,194,859 B1 * 3/2007 Sawdon ..... F15B 11/0325 60/565
7,494,035 B2 * 2/2009 Weaver ..... B25C 1/04 173/217
8,074,348 B2 * 12/2011 Haytayan ..... B25B 21/002 29/432
8,091,751 B2 * 1/2012 Tanaka ..... B25C 1/008 227/10
2004/0164117 A1 * 8/2004 Nishikawa ..... B25C 1/08 227/10
2005/0056680 A1 * 3/2005 Webb ..... B25C 1/00 227/9
2007/0208330 A1 * 9/2007 Treat ..... A61B 18/085 606/30
2010/0019014 A1 * 1/2010 Rodenhouse ..... B25B 21/002 227/32
2012/0255985 A1 * 10/2012 Ma ..... A61B 17/07207 227/175.1
2013/0152966 A1 * 6/2013 Jaresch ..... F28G 1/12 134/8
2015/0198327 A1 * 7/2015 Liu ..... F22B 1/22 122/40
2016/0023337 A1 * 1/2016 Liu ..... B25C 1/08 227/130

FOREIGN PATENT DOCUMENTS

| | | | |
|---|---|---|---|
| CN | 201884235 | U | 6/2011 |
| CN | 202659465 | U | 1/2013 |
| CN | 203584706 | U | 5/2014 |
| CN | 204024950 | U | 12/2014 |
| JP | 2004353623 | A | 12/2004 |

* cited by examiner

HIGH PRESSURE WATER PUMP

CROSS-REFERENCE TO RELATED APPLICATIONS

This application claims the priority to Chinese Patent Application Nos. 201410354531.0 and 201420411665.7, filed on Jul. 24, 2014, in the State Intellectual Property Office of P.R. China, which are incorporated herein in their entireties by reference.

FIELD

The present invention mainly relates to the field of nail driving tool, and more particularly to a high pressure water pump and steam powered nailing guns having the high pressure water pump.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

The power source of a conventional nailing gun is generally compressed air. Such a configuration requires air supply pipe to be connected to the nailing gun body. It is difficult and inconvenient to pull the air supply pipe and operate such a nailing gun. In addition, a user usually needs to wear protective earplugs because noise is relatively loud while using such nailing gun powered by compressed air. Moreover, an air compressor is required to provide compressed air. Since the air compressor is bulky, and heavy, the air compressor is difficult to carry from one work site to another work site. The air compressor itself is also costly. Moreover, the air compressor is expensive, and difficult to maintain. Some nailing guns choose to use high pressure water pump as power source, but these nailing guns generally have a short service life. Many parts or components need to be replaced quite frequently. Furthermore, the nailing forces vary during operation and production efficiency is greatly reduced.

Therefore, heretofore unaddressed needs exist in the art to address the aforementioned deficiencies and inadequacies.

SUMMARY

In one aspect, the present invention relates to a high pressure water pump. In certain embodiments, the high pressure water pump includes: an upper pump body, a lower pump body, a water discharge valve, a water intake valve, a plunger, a guide sleeve, a hammering cap, an adjustment knob, and an evacuation valve. The upper pump body and the lower pump body are connected by a plurality of connecting bolts. A sealing ring is disposed between the upper pump body and the lower pump body and a sealing element is disposed between the upper pump body and the plunger. The plunger is sheathed in the upper pump body. The hammering cap is connected to an upper end of the plunger by threads. The adjustment knob is connected to an upper end of the upper pump body. The hammering cap is moveably connected to the adjustment knob through the plunger. A plunger reset spring is disposed between the hammering cap and the adjustment knob.

In certain embodiments, the water intake valve, the water discharge valve, and the evacuation valve are disposed along the circumference of the lower pump body, and form a "Y" shaped three distribution channels on a same plane in the lower pump body. A working chamber is formed between the plunger, the upper pump body and the lower pump body. A water intake channel is formed at an end of the corresponding water intake valve. A water discharge channel is formed at an end of the corresponding water discharge valve. An evacuation channel is formed at an end of the corresponding evacuation valve. The water intake channel, the water discharge channel, and the evacuation valve are connected at the working chamber inside of the lower pump body.

In certain embodiments, the water intake valve is a check valve allowing water to flow into the working chamber from outside through the water intake valve. The water discharge valve is a check valve allowing water to flow out of the working chamber through the water discharge valve.

In certain embodiments, the water intake valve has an intake valve seat, an intake valve core, and an intake restoring spring. Each of the intake valve seat and the intake valve core has a sealing surface. The sealing surfaces of the intake valve seat and the intake valve core are attached closely under a preloaded pressure of the intake restoring spring.

In certain embodiments, the water discharge valve has a water intake port, a water discharge port, a discharge valve seat, a discharge valve core, a limiting rod, a discharge restoring spring, a discharge valve body, a locknut, and a water discharge pipe. The discharge valve body has a first end connected to the discharge valve seat and a second end connected to a water discharge pipe. The discharge valve core is disposed inside the discharge valve seat. The discharge valve core has a first end connected to the water intake port and a second end connected to the limiting rod. The limiting rod is located inside the discharge valve body. The discharge valve seat and the discharge valve core are coupled fitted parts. The fit clearance is 0.001 mm-0.003 mm. A gap is formed between the discharge valve core and the discharge valve seat. The gap between the discharge valve core and the discharge valve seat has at least one of a cross groove and a spiral groove.

In certain embodiments, the evacuation valve has an evacuation valve body, an evacuation valve core, and a compression spring. The evacuation valve core is disposed inside the evacuation valve body. The compression spring is disposed on the evacuation valve core, and a sealing conical surface is disposed between the evacuation valve body and the evacuation valve core.

In certain embodiments, a lining is disposed above the sealing element. The lining is made of an abrasion resistant and waterproof material. The guide sleeve has an upper external thread on an upper end of the guide sleeve, and a lower external thread on a lower end of the guide sleeve. The guide sleeve is disposed between the plunger and the adjustment knob. The guide sleeve is connected to the adjustment knob through the upper external thread, and to the upper pump body through the lower external thread.

In certain embodiments, a preloaded spring is disposed between the adjustment knob and the upper pump body. The sealing element is an O-ring.

In another aspect, the present invention relates to a steam powered nailing gun. In certain embodiments, the steam powered nailing gun includes a high pressure water pump. The high pressure water pump includes: an upper pump body, a lower pump body, a water discharge valve, a water intake valve, a plunger, a guide sleeve, a hammering cap, an adjustment knob, and an evacuation valve. The upper pump body and the lower pump body are connected by a plurality of connecting bolts. A sealing ring is disposed between the upper pump body and the lower pump body and a sealing element is disposed between the upper pump body and the plunger. The plunger is sheathed in the upper pump body. The hammering cap is connected to an upper end of the plunger by threads. The adjustment knob is connected to an upper end of the upper pump body. The hammering cap is moveably connected to the adjustment knob through the plunger. A plunger reset spring is disposed between the hammering cap and the adjustment knob.

In certain embodiments, the water intake valve, the water discharge valve, and the evacuation valve are disposed along the circumference of the lower pump body, and form a "Y" shaped three distribution channels on a same plane in the lower pump body. A working chamber is formed between the plunger, the upper pump body and the lower pump body. A water intake channel is formed at an end of the corresponding water intake valve. A water discharge channel is formed at an end of the corresponding water discharge valve. An evacuation channel is formed at an end of the corresponding evacuation valve. The water intake channel, the water discharge channel, and the evacuation valve are connected at the working chamber inside of the lower pump body.

In certain embodiments, the water intake valve is a check valve allowing water to flow into the working chamber from outside through the water intake valve. The water discharge valve is a check valve allowing water to flow out of the working chamber through the water discharge valve.

In certain embodiments, the water intake valve has an intake valve seat, an intake valve core, and an intake restoring spring. Each of the intake valve seat and the intake valve core has a sealing surface. The sealing surfaces of the intake valve seat and the intake valve core are attached closely under a preloaded pressure of the intake restoring spring.

In certain embodiments, the water discharge valve has a water intake port, a water discharge port, a discharge valve seat, a discharge valve core, a limiting rod, a discharge restoring spring, a discharge valve body, a locknut, and a water discharge pipe. The discharge valve body has a first end connected to the discharge valve seat and a second end connected to a water discharge pipe. The discharge valve core is disposed inside the discharge valve seat. The discharge valve core has a first end connected to the water intake port and a second end connected to the limiting rod. The limiting rod is located inside the discharge valve body. The discharge valve seat and the discharge valve core are coupled fitted parts. The fit clearance is 0.001 mm-0.003 mm. A gap is formed between the discharge valve core and the discharge valve seat. The gap between the discharge valve core and the discharge valve seat has at least one of a cross groove and a spiral groove.

In certain embodiments, the evacuation valve has an evacuation valve body, an evacuation valve core, and a compression spring. The evacuation valve core is disposed inside the evacuation valve body. The compression spring is disposed on the evacuation valve core, and a sealing conical surface is disposed between the evacuation valve body and the evacuation valve core.

In certain embodiments, a lining is disposed above the sealing element. The lining is made of an abrasion resistant and waterproof material. The guide sleeve has an upper external thread on an upper end of the guide sleeve, and a lower external thread on a lower end of the guide sleeve. The guide sleeve is disposed between the plunger and the adjustment knob. The guide sleeve is connected to the adjustment knob through the upper external thread, and to the upper pump body through the lower external thread.

In certain embodiments, a preloaded spring is disposed between the adjustment knob and the upper pump body. The sealing element is an O-ring.

Beneficial effects of the present invention include: it has a long service life, and high production efficiency, it ensures the pump output, and the nailing forces are consistent at all time.

These and other aspects of the present invention will become apparent from the following description of the preferred embodiment taken in conjunction with the following drawings, although variations and modifications therein may be effected without departing from the spirit and scope of the novel concepts of the invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment. The drawings do not limit the present invention to the specific embodiments disclosed and described herein. The drawings are not necessarily to scale, emphasis instead being placed upon clearly illustrating the principles of the invention, and wherein.

DETAILED DESCRIPTION

Figure 1:
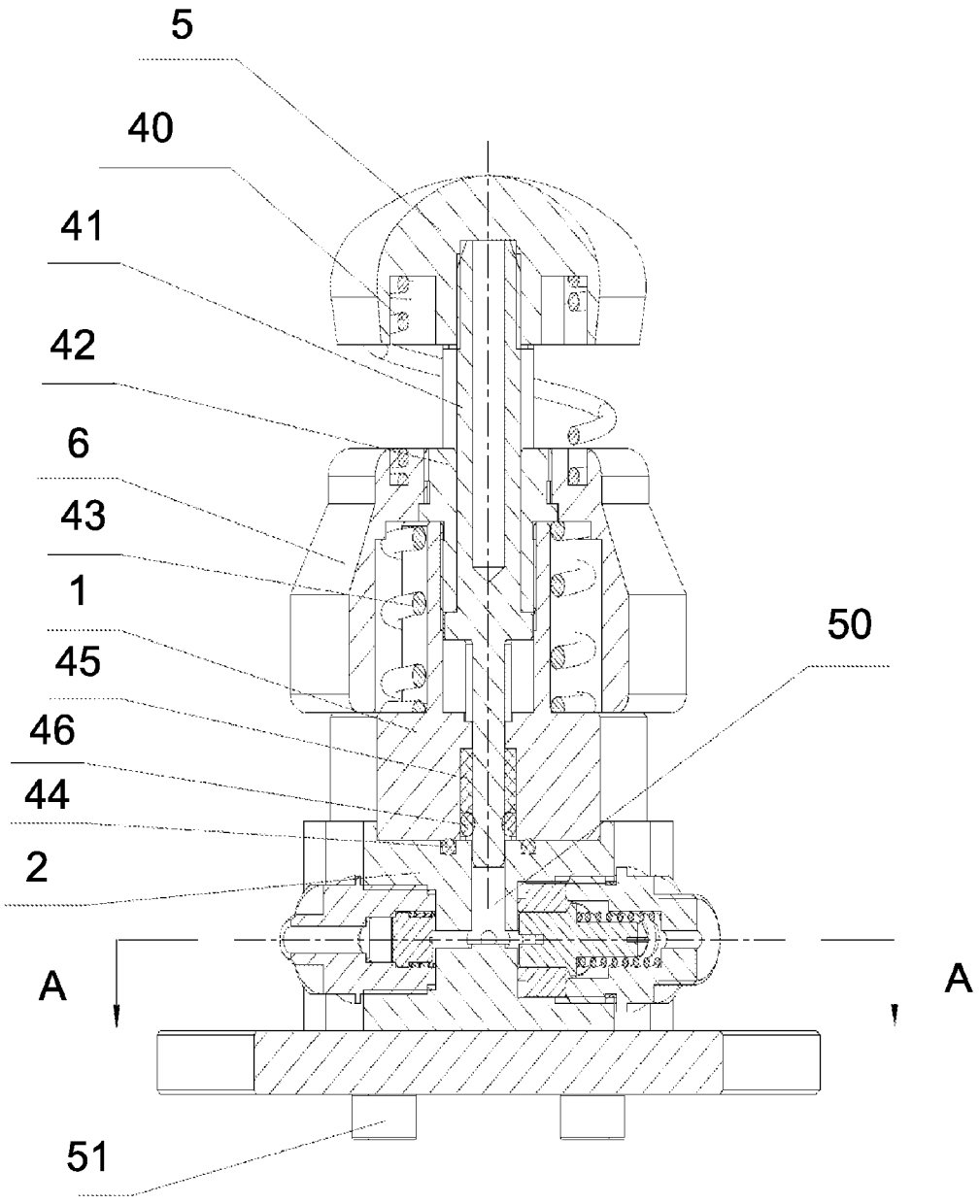
FIG. 1 is a partial sectional structural view of a high pressure water pump for a steam powered nailing gun according to certain embodiments of the present invention.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximates, meaning that the term "around", "about" or "approximately" can be inferred if not expressly stated.

Many specific details are provided in the following descriptions to make the present invention be fully understood, but the present invention may also be implemented by using other manners different from those described herein, so that the present invention is not limited by the specific embodiments disclosed in the following.

The description will be made as to the embodiments of the present invention in conjunction with the accompanying drawings FIGS. 1-8. In accordance with the purposes of this invention, as embodied and broadly described herein, this invention, in one aspect, relates to a high pressure water pump.

Figure 2:
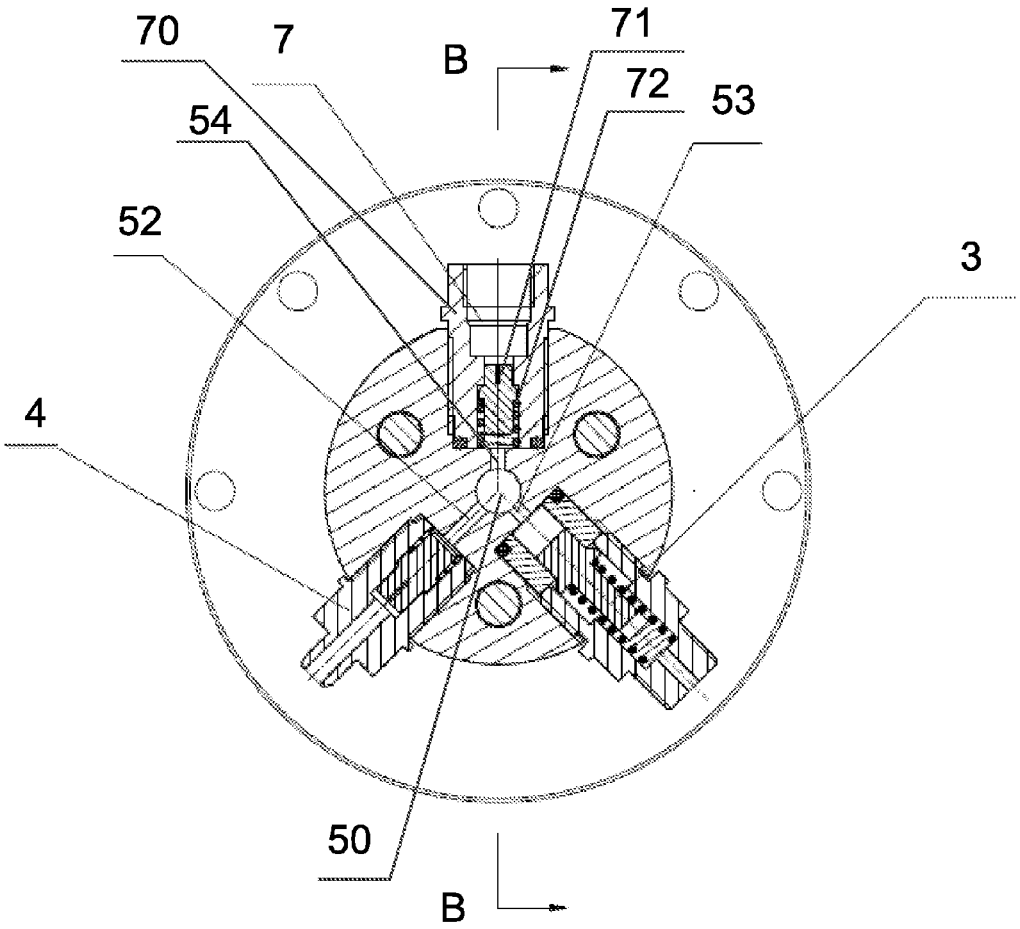
FIG. 2 is a sectional view along a direction A-A of the high pressure water pump as shown in the FIG. 1, according to one embodiment of the present invention.
Figure 3:
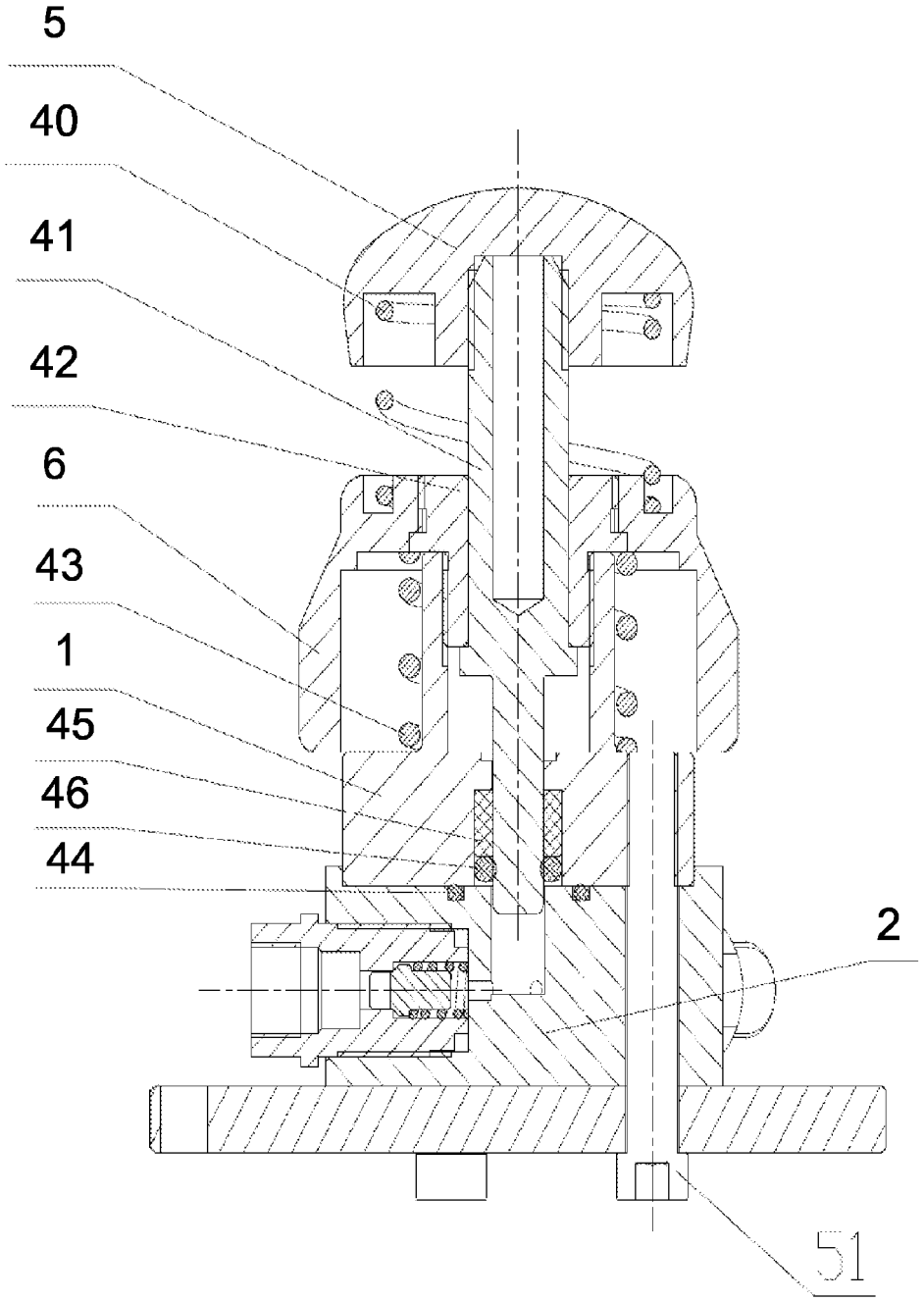
FIG. 3 is a sectional view along a direction B-B of the high pressure water pump as shown in the FIG. 2, according to one embodiment of the present invention.

In certain embodiments, as shown in FIGS. 1-3, the high pressure water pump includes: an upper pump body 1, a lower pump body 2, a water discharge valve 3, a water intake valve 4, a plunger 41, a guide sleeve 42, a hammering cap 5, an adjustment knob 6, and an evacuation valve 7. The upper pump body 1 and the lower pump body 2 are connected by a plurality of connecting bolts 51. A sealing ring 44 is disposed between the upper pump body 1 and the lower pump body 2 and a sealing element 46 is disposed between the upper pump body 1 and the plunger 41. The sealing ring 44 and the sealing element 46 are used to provide sealing and prevent leakage. The sealing element 46 may be an O-ring, or a sealing ring and a material in other forms.

In certain embodiments, a lining 45 is disposed above the sealing element 46. The lining 45 is made of an abrasion resistant and waterproof material. The lining 45 is made of an abrasion resistant and waterproof material and is located above the sealing element 46. The function of the lining 45 is to improve the coaxiality of the plunger 41 and the sealing element 46, to improve the sealing effect of the sealing element 46 and also reduce the abrasion of the sealing element 46.

In certain embodiments, the plunger 41 is sheathed in the upper pump body 1. The hammering cap 5 is connected to an upper end of the plunger 41 by threads. The adjustment knob 6 is connected to an upper end of the upper pump body 1. The hammering cap 5 is moveably connected to the adjustment knob 6 through the plunger 41. A plunger reset spring 40 is disposed between the hammering cap 5 and the adjustment knob 6. The plunger reset spring 40 is used to pull the plunger 41 back to its initial position.

When the plunger 41 is used to discharge water, the total amount of water discharged=the plunger moving distance× the cross-sectional area of the plunger 41. The plunger moving distance can be adjusted by the adjustment knob 6. When the moving distance is increased, the water discharged and the thrust generated by the discharged water are increased. Therefore the nailing forces of a steam powered nailing gun may be controlled by adjusting the adjustment knob 6.

The guide sleeve 42 has an upper external thread on an upper end of the guide sleeve 42, and a lower external thread on a lower end of the guide sleeve 42. The guide sleeve 42 is disposed between the plunger 41 and the adjustment knob 6. The guide sleeve 42 is connected to the adjustment knob 6 through the upper external thread, and to the upper pump body 1 through the lower external thread. The guide sleeve 42 has a guiding function when the plunger 41 moves up and down, and the guide sleeve 42 is made of an abrasion resistant material.

In certain embodiments, a preloaded spring 43 is disposed between the adjustment knob 6 and the upper pump body 1. The preloaded spring 43 is used to enhance the touch feeling of the adjustment knob 6.

In certain embodiments, as shown in FIG. 2, the water intake valve 4, the water discharge valve 3, and the evacuation valve 7 are disposed along the circumference of the lower pump body 2, and form a "Y" shaped three distribution channels on a same plane in the lower pump body 2. A working chamber 50 is formed between the plunger 41, the upper pump body 1 and the lower pump body 2. A water intake channel 52 is formed at an end of the corresponding water intake valve 4. A water discharge channel 53 is formed at an end of the corresponding water discharge valve 3. An evacuation channel 54 is formed at an end of the corresponding evacuation valve 7. The water intake channel 52, the water discharge channel 53, and the evacuation valve 7 are connected at the working chamber 50 inside of the lower pump body 2.

In certain embodiments, as shown in FIG. 1 and FIG. 2, the water intake valve 4 is a check valve allowing water to flow into the working chamber 50 from outside through the water intake valve 4. The water intake valve 4 is communicated with a water tank through a pipe to form a flow passage. The water discharge valve 3 is a check valve allowing water to flow out of the working chamber 50 through the water discharge valve 3.

Figure 4:
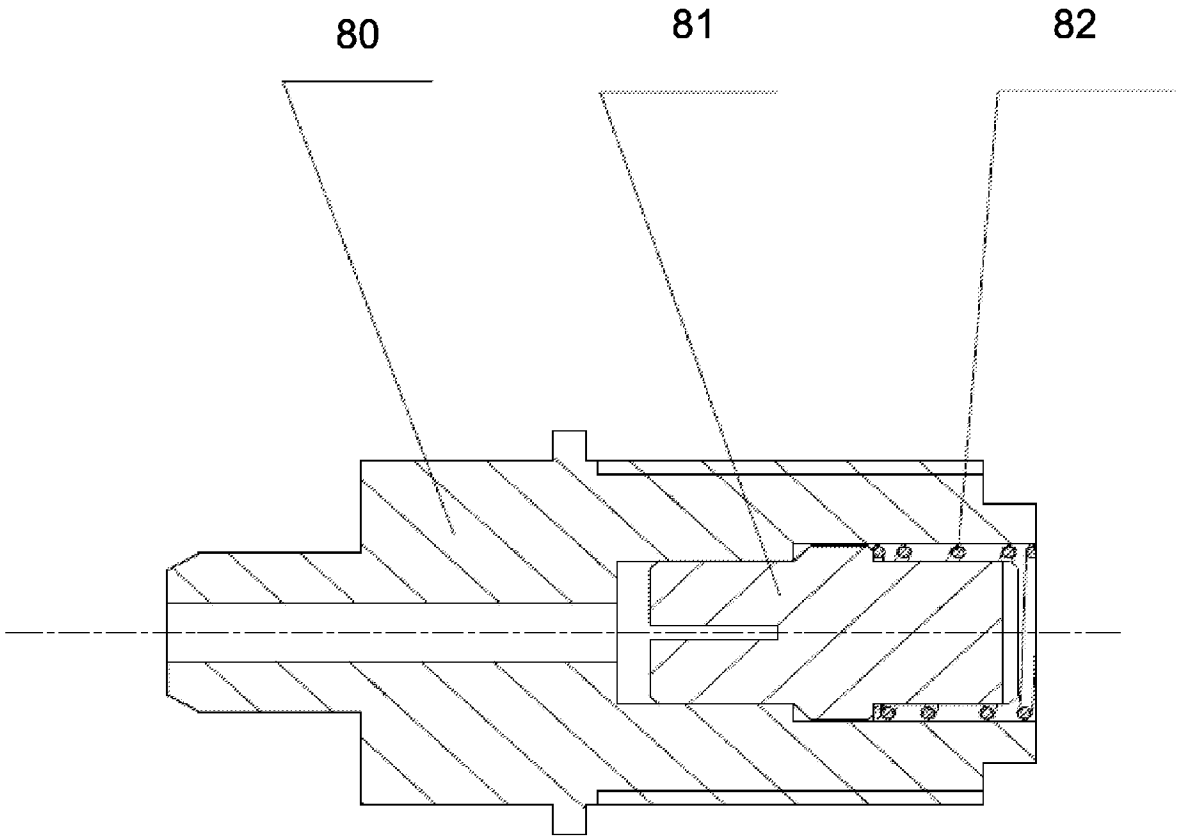
FIG. 4 is a schematic structural view of a water intake valve 4 of the high pressure water pump according to one embodiment of the present invention.
Figure 5:
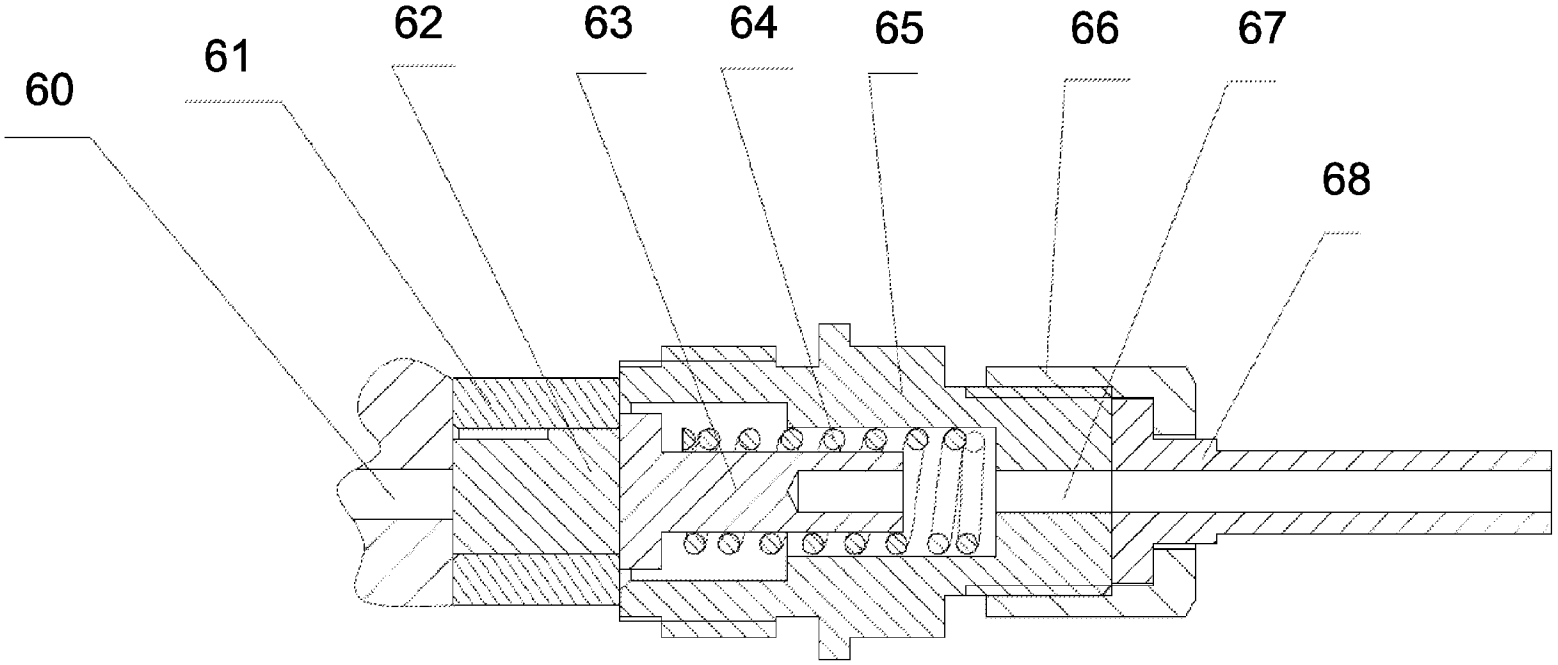
FIG. 5 is a schematic structural view of a water discharge valve 3 of the high pressure water pump according to one embodiment of the present invention.

In certain embodiments, as shown in FIG. 4, the water intake valve 4 has an intake valve seat 80, an intake valve core 81, and an intake restoring spring 82. Each of the intake valve seat 80 and the intake valve core 81 has a sealing surface. The sealing surfaces of the intake valve seat 80 and the intake valve core 81 are attached closely under a preloaded pressure of the intake restoring spring 82. When the air in the working chamber 50 is sucked out through the evacuation channel 54, a vacuum is formed inside working chamber 50. The intake valve core 81 opens by overcoming the resilient force of the intake restoring spring 82 under the action of the atmospheric pressure, so that the water in the water intake pipe 88 is sucked into the working chamber 50 of the high pressure water pump. When the working chamber 50 is under a high pressure, the intake valve seat 80 and the intake valve core 81 are closely attached and sealed, so that the water will not leak out of the working chamber 50. Therefore the water intake valve 4 functions as a check valve.

In certain embodiments, as shown in FIGS. 5-8, the water discharge valve 3 has a water intake port 60, a water discharge port 67, a discharge valve seat 61, a discharge valve core 62, a limiting rod 63, a discharge restoring spring 64, a discharge valve body 65, a locknut 66, and a water discharge pipe 68. The discharge valve body 65 has a first end connected to the discharge valve seat 61 and a second end connected to a water discharge pipe 68. The discharge valve core 62 is disposed inside the discharge valve seat 61. The discharge valve core 62 has a first end connected to the water intake port 60 and a second end connected to the limiting rod 63. The limiting rod 63 is located inside the discharge valve body 65. The limiting rod 63 has a limiting function to prevent the discharge valve core 62 from getting out of the discharge valve seat 61.

The discharge valve seat 61 and the discharge valve core 62 are coupled fitted parts. The fit clearance is 0.001 mm-0.003 mm. A gap 69 is formed between the discharge valve core 62 and the discharge valve seat 61. The gap 69 between the discharge valve core 62 and the discharge valve seat 61 may take many different forms. In one embodiment, the gap 69 between the discharge valve core 62 and the discharge valve seat 61 is a cross groove. In another embodiment, the gap 69 between the discharge valve core 62 and the discharge valve seat 61 is a spiral groove. The gap 69 of the valve core 62 may be in multiple forms, such as, a cross groove and a spiral groove. The locknut 66 is used to fasten the water outlet pipe 68.

Figure 6:
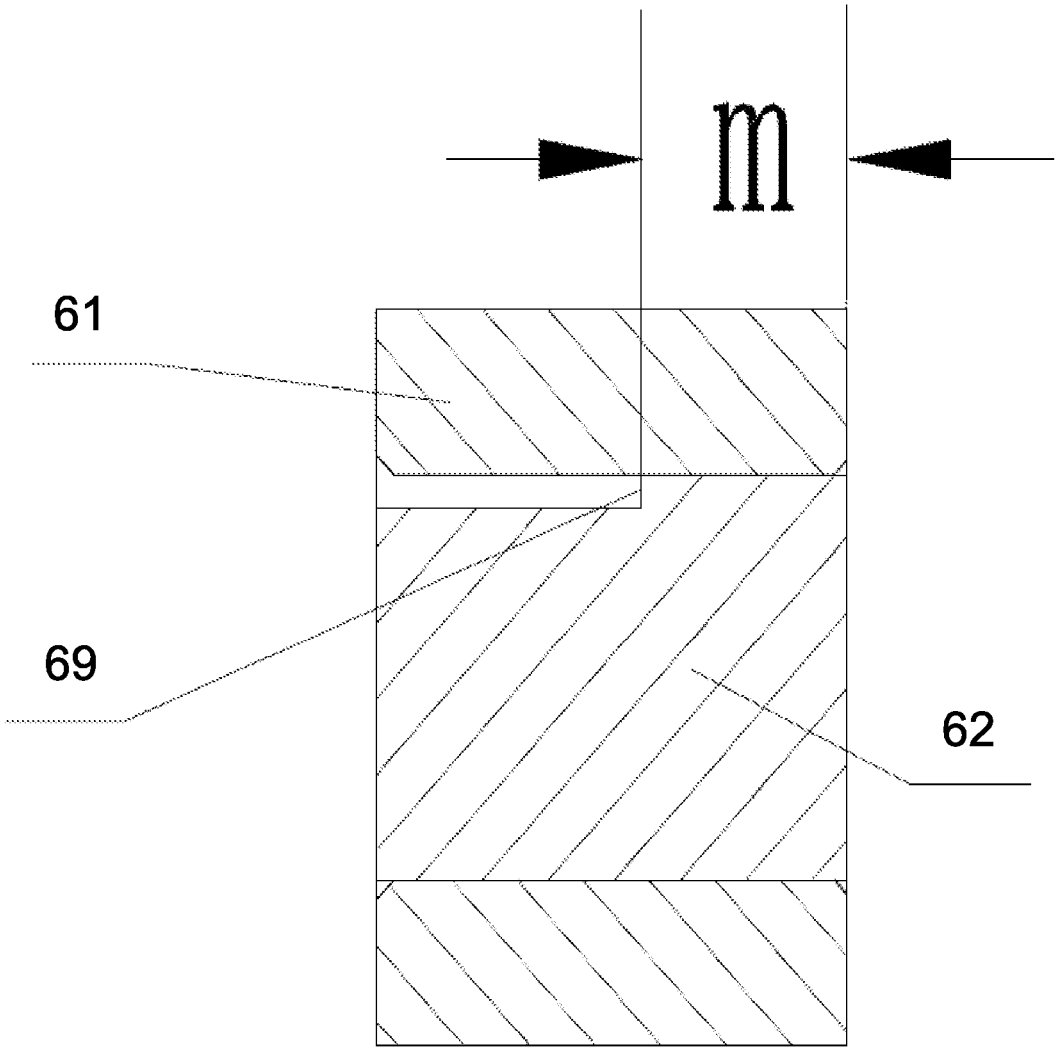
FIG. 6 is a state view showing a gap of a valve core of the water discharge valve 3 of the high pressure water pump as shown in FIG. 5 according to one embodiment of the present invention.
Figure 7:
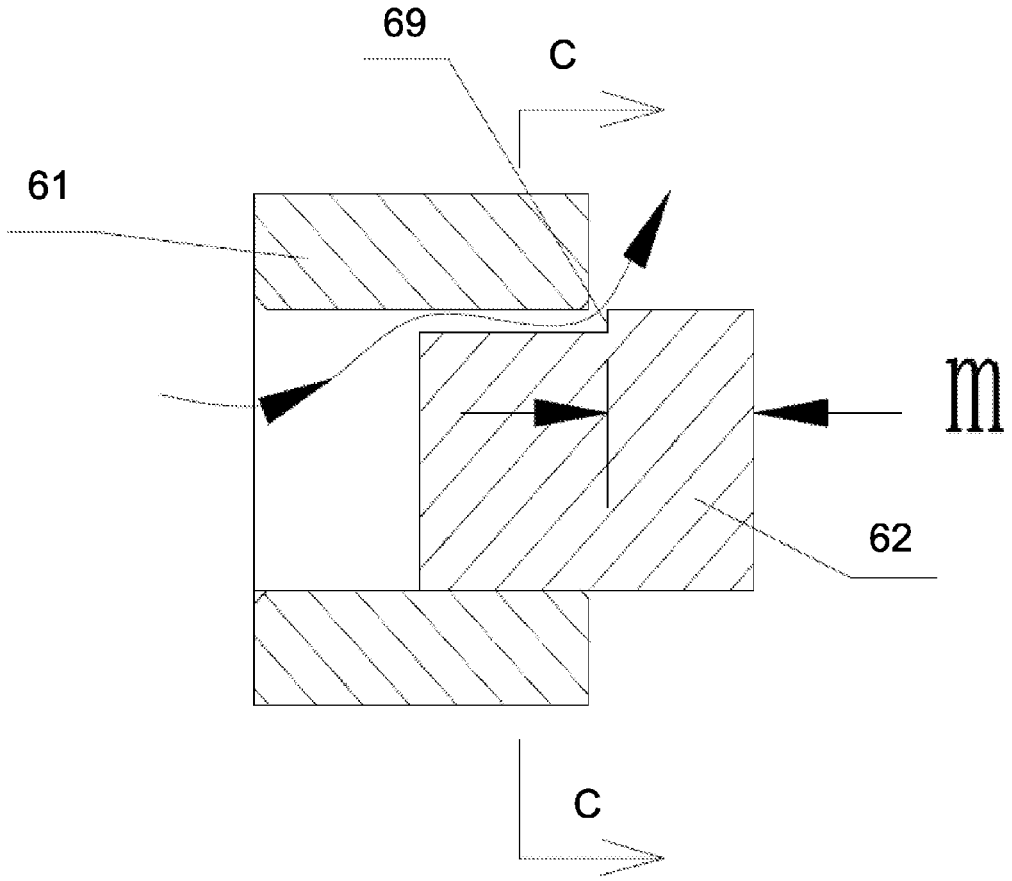
FIG. 7 is a state view showing a water discharge channel 53 is formed when the valve core moved out of the valve seat 61 under water pressure according to one embodiment of the present invention.
Figure 8:
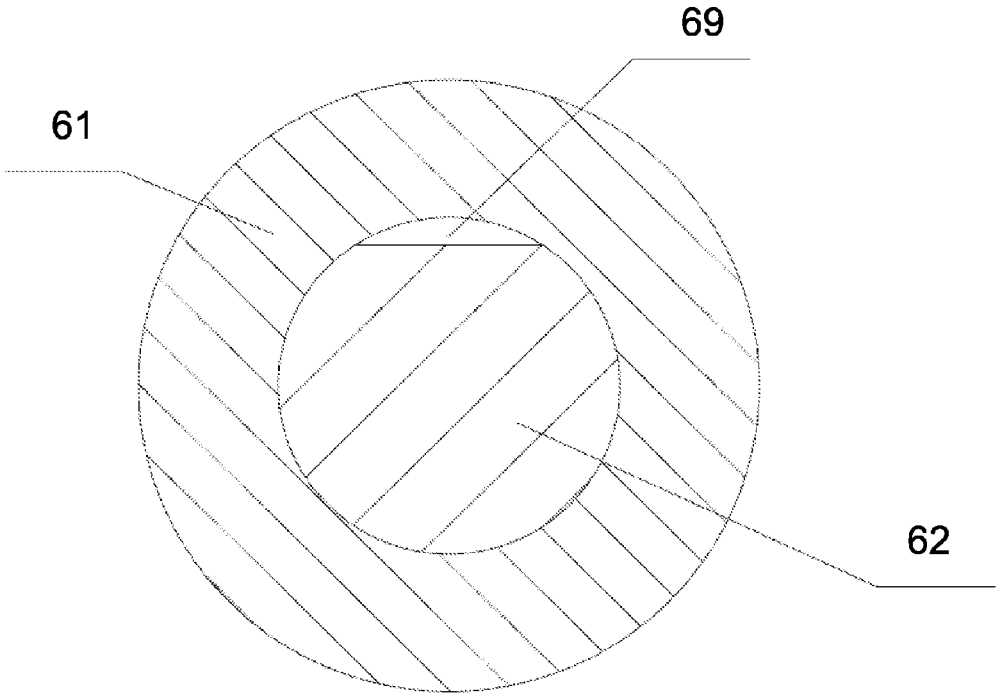
FIG. 8 is a sectional view along a direction C-C of the water discharge valve 3 of the high pressure water pump as shown in FIG. 7 according to one embodiment of the present invention.

As shown in FIG. 6, only when the discharge valve core 62 has the gap 69 exposed out of the discharge valve seat 61 under the push of a water pressure, that is, only when the moving distance is greater than m, the high-pressure water can flow out, where m is the displacement distance. When the water pressure reduces, the discharge restoring spring 64 pushes the discharge valve core 62 to return to its initial position. At this time, a vacancy volume is formed in the inner chamber of the discharge valve body 65, the water in the vacancy volume must be supplied by the water in the water discharge port 67 and the water discharge pipe 68, and the vacancy volume=displacement distance m×the cross-sectional area of the discharge valve core 62. In this way, only limited amount of water is left in the pipeline of the water discharge pipe 68, so that the water is not evaporated by heat transmitted from a high-temperature portion causing insufficient amount of water for next nailing action. This structure ensures that consistent pump outputs of the high-pressure water pump at all time and further ensures that the consistency of the nailing forces at all time.

In certain embodiments, as shown in FIG. 2, the evacuation valve 7 has an evacuation valve body 70, an evacuation valve core 71, and a compression spring 72. The evacuation valve core 71 is disposed inside the evacuation valve body 70. The compression spring 72 is disposed on the evacuation valve core 71, and a sealing conical surface is disposed between the evacuation valve body 70 and the evacuation valve core 71. Where air is present in the working chamber 50 of the high pressure water pump, the high pressure water pump cannot suck water to work normally, so that the air must be removed. The evacuation valve 7 is used for removing the air in the working chamber 50. The evacuation valve core 71 is disposed inside the evacuation valve body 70, a compression spring 72 is disposed on the evacuation valve core 71. A sealing conical surface is disposed between the evacuation valve body 70 and the evacuation valve core 71. As long as the evacuation valve core 71 is propped open by an external force overcoming the compression spring 72, the air in the water pump can be pumped out by making use of the vacuum. The evacuation valve 7 may also be integrated with an external air pumping apparatus and mounted as a whole on the nailing gun body, so that it is convenient in use. The evacuation valve 7 is connected to the lower pump body 2 of the high pressure water pump by threads so as to be communicated with the working chamber 50.

In another aspect, the present invention relates to a steam powered nailing gun. The steam powered nailing gun includes a high pressure water pump. In certain embodiments, as shown in FIGS. 1-3, the high pressure water pump includes: an upper pump body 1, a lower pump body 2, a water discharge valve 3, a water intake valve 4, a plunger 41, a guide sleeve 42, a hammering cap 5, an adjustment knob 6, and an evacuation valve 7. The upper pump body 1 and the lower pump body 2 are connected by a plurality of connecting bolts 51. A sealing ring 44 is disposed between the upper pump body 1 and the lower pump body 2 and a sealing element 46 is disposed between the upper pump body 1 and the plunger 41. The sealing ring 44 and the sealing element 46 are used to provide sealing and prevent leakage. The sealing element 46 may be an O-ring, or a sealing ring and a material in other forms.

In certain embodiments, a lining 45 is disposed above the sealing element 46. The lining 45 is made of an abrasion resistant and waterproof material. The lining 45 is made of an abrasion resistant and waterproof material and is located above the sealing element 46. The function of the lining 45 is to improve the coaxiality of the plunger 41 and the sealing element 46, to improve the sealing effect of the sealing element 46 and also reduce the abrasion of the sealing element 46.

In certain embodiments, the plunger 41 is sheathed in the upper pump body 1. The hammering cap 5 is connected to an upper end of the plunger 41 by threads. The adjustment knob 6 is connected to an upper end of the upper pump body 1. The hammering cap 5 is moveably connected to the adjustment knob 6 through the plunger 41. A plunger reset spring 40 is disposed between the hammering cap 5 and the adjustment knob 6. The plunger reset spring 40 is used to pull the plunger 41 back to its initial position.

When the plunger 41 is used to discharge water, the total amount of water discharged=the plunger moving distance× the cross-sectional area of the plunger 41. The plunger moving distance can be adjusted by the adjustment knob 6. When the moving distance is increased, the water discharged and the thrust generated by the discharged water are increased. Therefore the nailing forces of a steam powered nailing gun may be controlled by adjusting the adjustment knob 6.

The guide sleeve 42 has an upper external thread on an upper end of the guide sleeve 42, and a lower external thread on a lower end of the guide sleeve 42. The guide sleeve 42 is disposed between the plunger 41 and the adjustment knob 6. The guide sleeve 42 is connected to the adjustment knob 6 through the upper external thread, and to the upper pump body 1 through the lower external thread. The guide sleeve 42 has a guiding function when the plunger 41 moves up and down, and the guide sleeve 42 is made of an abrasion resistant material.

In certain embodiments, a preloaded spring 43 is disposed between the adjustment knob 6 and the upper pump body 1. The preloaded spring 43 is used to enhance the touch feeling of the adjustment knob 6.

In certain embodiments, as shown in FIG. 2, the water intake valve 4, the water discharge valve 3, and the evacuation valve 7 are disposed along the circumference of the lower pump body 2, and form a "Y" shaped three distribution channels on a same plane in the lower pump body 2. A working chamber 50 is formed between the plunger 41, the upper pump body 1 and the lower pump body 2. A water intake channel 52 is formed at an end of the corresponding water intake valve 4. A water discharge channel 53 is formed at an end of the corresponding water discharge valve 3. An evacuation channel 54 is formed at an end of the corresponding evacuation valve 7. The water intake channel 52, the water discharge channel 53, and the evacuation valve 7 are connected at the working chamber 50 inside of the lower pump body 2.

In certain embodiments, as shown in FIG. 1 and FIG. 2, the water intake valve 4 is a check valve allowing water to flow into the working chamber 50 from outside through the water intake valve 4. The water intake valve 4 is communicated with a water tank through a pipe to form a flow passage. The water discharge valve 3 is a check valve allowing water to flow out of the working chamber 50 through the water discharge valve 3.

In certain embodiments, as shown in FIG. 4, the water intake valve 4 has an intake valve seat 80, an intake valve core 81, and an intake restoring spring 82. Each of the intake valve seat 80 and the intake valve core 81 has a sealing surface. The sealing surfaces of the intake valve seat 80 and the intake valve core 81 are attached closely under a preloaded pressure of the intake restoring spring 82. When the air in the working chamber 50 is sucked out through the evacuation channel 54, a vacuum is formed inside working chamber 50. The intake valve core 81 opens by overcoming the resilient force of the intake restoring spring 82 under the action of the atmospheric pressure, so that the water in the water intake pipe 88 is sucked into the working chamber 50 of the high pressure water pump. When the working chamber 50 is under a high pressure, the intake valve seat 80 and the intake valve core 81 are closely attached and sealed, so that the water will not leak out of the working chamber 50. Therefore the water intake valve 4 functions as a check valve.

In certain embodiments, as shown in FIGS. 5-8, the water discharge valve 3 has a water intake port 60, a water discharge port 67, a discharge valve seat 61, a discharge valve core 62, a limiting rod 63, a discharge restoring spring 64, a discharge valve body 65, a locknut 66, and a water discharge pipe 68. The discharge valve body 65 has a first end connected to the discharge valve seat 61 and a second end connected to a water discharge pipe 68. The discharge valve core 62 is disposed inside the discharge valve seat 61. The discharge valve core 62 has a first end connected to the water intake port 60 and a second end connected to the limiting rod 63. The limiting rod 63 is located inside the discharge valve body 65. The limiting rod 63 has a limiting function to prevent the discharge valve core 62 from getting out of the discharge valve seat 61.

The discharge valve seat 61 and the discharge valve core 62 are coupled fitted parts. The fit clearance is 0.001 mm-0.003 mm. A gap 69 is formed between the discharge valve core 62 and the discharge valve seat 61. The gap 69 between the discharge valve core 62 and the discharge valve seat 61 may take many different forms. In one embodiment, the gap 69 between the discharge valve core 62 and the discharge valve seat 61 is a cross groove. In another embodiment, the gap 69 between the discharge valve core 62 and the discharge valve seat 61 is a spiral groove. The gap 69 of the valve core 62 may be in multiple forms, such as, a cross groove and a spiral groove. The locknut 66 is used to fasten the water outlet pipe 68.

As shown in FIG. 6, only when the discharge valve core 62 has the gap 69 exposed out of the discharge valve seat 61 under the push of a water pressure, that is, only when the moving distance is greater than m, the high-pressure water can flow out, where m is the displacement distance. When the water pressure reduces, the discharge restoring spring 64 pushes the discharge valve core 62 to return to its initial position. At this time, a vacancy volume is formed in the inner chamber of the discharge valve body 65, the water in the vacancy volume must be supplied by the water in the water discharge port 67 and the water discharge pipe 68, and the vacancy volume=displacement distance m×the cross-sectional area of the discharge valve core 62. In this way, only limited amount of water is left in the pipeline of the water discharge pipe 68, so that the water is not evaporated by heat transmitted from a high-temperature portion causing insufficient amount of water for next nailing action. This structure ensures that consistent pump outputs of the high-pressure water pump at all time and further ensures that the consistency of the nailing forces at all time.

In certain embodiments, as shown in FIG. 2, the evacuation valve 7 has an evacuation valve body 70, an evacuation valve core 71, and a compression spring 72. The evacuation valve core 71 is disposed inside the evacuation valve body 70. The compression spring 72 is disposed on the evacuation valve core 71, and a sealing conical surface is disposed between the evacuation valve body 70 and the evacuation valve core 71. Where air is present in the working chamber 50 of the high pressure water pump, the high pressure water pump cannot suck water to work normally, so that the air must be removed. The evacuation valve 7 is used for removing the air in the working chamber 50. The evacuation valve core 71 is disposed inside the evacuation valve body 70, a compression spring 72 is disposed on the evacuation valve core 71. A sealing conical surface is disposed between the evacuation valve body 70 and the evacuation valve core 71. As long as the evacuation valve core 71 is propped open by an external force overcoming the compression spring 72, the air in the water pump can be pumped out by making use of the vacuum. The evacuation valve 7 may also be integrated with an external air pumping apparatus and mounted as a whole on the nailing gun body, so that it is convenient in use. The evacuation valve 7 is connected to the lower pump body 2 of the high pressure water pump by threads so as to be communicated with the working chamber 50.

When the high pressure water pump is used in a steam powered nailing gun, an operator uses a hammer to hit the beat the hammering cap 5 of the high pressure water pump, the plunger 41 presses the water in the working chamber 50 to generate a body of water in high pressure. The body of water in high pressure passes through the water discharge valve 3 of the high pressure water pump, a high pressure water discharge pipe, and the water intake pipe, and enters a steam power generator (system) to generate high-temperature and high-pressure steam. The high-temperature and high-pressure steam is used to drive nails into wood panels.

The present invention uses high pressure steam as a power source, ordinary liquid water is turned into high pressure steam to drive a piston mechanism to work, and drive a firing pin to drive a nail into an object. As steam is used as a power source, compared with air compression, electrical power supply, rechargeable batteries or gases, the steam powered nailing gun has a compact size, light weight, low cost, and is easy to carry and transport and safe and reliable to use. It may effectively save the cost for enterprises, and improve economic efficiency of the enterprises.

The power supply required in the present invention may be a domestic or industrial alternating current, or may be provided by a rechargeable battery.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims, the foregoing description and the exemplary embodiments described therein, and accompanying drawings.

What is claimed is:

1. A high pressure water pump, comprising:

an upper pump body;

a lower pump body;

a water discharge valve;

a water intake valve;

a plunger;

a guide sleeve;

a hammering cap;

an adjustment knob; and an evacuation valve, wherein the upper pump body and the lower pump body are connected by a plurality of connecting bolts, a sealing ring is disposed between the upper pump body and the lower pump body, a sealing element is disposed between the upper pump body and the plunger, the plunger is sheathed in the upper pump body, the hammering cap is connected to an upper end of the plunger by threads, the adjustment knob is connected to an upper end of the upper pump body, the hammering cap is moveably connected to the adjustment knob through the plunger, and a plunger reset spring is disposed between the hammering cap and the adjustment knob.

2. The high pressure water pump according to claim 1, wherein the water intake valve, the water discharge valve, and the evacuation valve are disposed along the circumference of the lower pump body, and form a "Y" shaped three distribution channels on a same plane in the lower pump body.

3. The high pressure water pump according to claim 2, wherein a working chamber is formed between the plunger, the upper pump body and the lower pump body.

4. The high pressure water pump according to claim 3, wherein a water intake channel is formed at an end of the corresponding water intake valve, a water discharge channel is formed at an end of the corresponding water discharge valve, an evacuation channel is formed at an end of the corresponding evacuation valve, and the water intake channel, the water discharge channel, and the evacuation valve are connected at the working chamber inside of the lower pump body.

5. The high pressure water pump according to claim 3, wherein the water intake valve is a check valve allowing water to flow into the working chamber from outside through the water intake valve.

6. The high pressure water pump according to claim 3, wherein the water discharge valve is a check valve allowing water to flow out of the working chamber through the water discharge valve.

7. The high pressure water pump according to claim 1, wherein the water intake valve comprises an intake valve seat, an intake valve core, and an intake restoring spring, wherein each of the intake valve seat and the intake valve core has a sealing surface, and the sealing surfaces of the intake valve seat and the intake valve core are attached closely under a preloaded pressure of the intake restoring spring.

8. The high pressure water pump according to claim 1, wherein the water discharge valve comprises a water intake port, a water discharge port, a discharge valve seat, a discharge valve core, a limiting rod, a discharge restoring spring, a discharge valve body, a locknut, and a water discharge pipe, wherein the discharge valve body has a first end connected to the discharge valve seat and a second end connected to a water discharge pipe, the discharge valve core is disposed inside the discharge valve seat, the discharge valve core has a first end connected to the water intake port and a second end connected to the limiting rod, the limiting rod is located inside the discharge valve body, the discharge valve seat and the discharge valve core are coupled fitted parts, the fit clearance is 0.001 mm-0.003 mm, and a gap is formed between the discharge valve core and the discharge valve seat.

9. The high pressure water pump according to claim 8, wherein the gap between the discharge valve core and the discharge valve seat comprises at least one of a cross groove and a spiral groove.

10. The high pressure water pump according to claim 1, wherein the evacuation valve comprises an evacuation valve body, an evacuation valve core, and a compression spring, wherein the evacuation valve core is disposed inside the evacuation valve body, the compression spring is disposed on the evacuation valve core, and a sealing conical surface is disposed between the evacuation valve body and the evacuation valve core.

11. The high pressure water pump according to claim 1, wherein a lining is disposed above the sealing element, and the lining is made of an abrasion resistant and waterproof material.

12. The high pressure water pump according to claim 1, wherein the guide sleeve has an upper external thread on an upper end of the guide sleeve, and a lower external thread on a lower end of the guide sleeve, the guide sleeve is disposed between the plunger and the adjustment knob, and the guide sleeve is connected to the adjustment knob through the upper external thread, and to the upper pump body through the lower external thread.

13. The high pressure water pump according to claim 1, wherein a preloaded spring is disposed between the adjustment knob and the upper pump body.

14. The high pressure water pump according to claim 1, wherein the sealing element is an O-ring.

15. A steam powered nailing gun comprising a high pressure water pump, wherein the high pressure water pump comprises:

an upper pump body;
a lower pump body;
a water discharge valve;
a water intake valve;
a plunger;
a guide sleeve;
a hammering cap;
an adjustment knob; and
an evacuation valve, wherein the upper pump body and the lower pump body are connected by a plurality of connecting bolts, a sealing ring is disposed between the upper pump body and the lower pump body, a sealing element is disposed between the upper pump body and the plunger, the plunger is sheathed in the upper pump body, the hammering cap is connected to an upper end of the plunger by threads, the adjustment knob is connected to an upper end of the upper pump body, the hammering cap is moveably connected to the adjustment knob through the plunger, and a plunger reset spring is disposed between the hammering cap and the adjustment knob.

16. The steam powered nailing gun according to claim 15, wherein a working chamber is formed between the plunger, the upper pump body and the lower pump body, a water intake channel is formed at an end of the corresponding water intake valve, a water discharge channel is formed at an end of the corresponding water discharge valve, an evacuation channel is formed at an end of the corresponding evacuation valve, and the water intake channel, the water discharge channel, and the evacuation valve are connected at the working chamber inside of the lower pump body.

17. The steam powered nailing gun according to claim 16, wherein the water intake valve is a check valve allowing water to flow into the working chamber from outside through the water intake valve, the water intake valve comprises an intake valve seat, an intake valve core, and an intake restoring spring, each of the intake valve seat and the intake valve core has a sealing surface, and the sealing surfaces of the intake valve seat and the intake valve core are attached closely under a preloaded pressure of the intake restoring spring.

18. The steam powered nailing gun according to claim 17, wherein the water discharge valve is a check valve allowing water to flow out of the working chamber through the water discharge valve, the water discharge valve comprises a water intake port, a water discharge port, a discharge valve seat, a discharge valve core, a limiting rod, a discharge restoring spring, a discharge valve body, a locknut, and a water discharge pipe, the discharge valve body has a first end connected to the discharge valve seat and a second end connected to a water discharge pipe, the discharge valve core is disposed inside the discharge valve seat, the discharge valve core has a first end connected to the water intake port and a second end connected to the limiting rod, the limiting rod is located inside the discharge valve body, the discharge valve seat and the discharge valve core are coupled fitted parts, the fit clearance is 0.001 mm-0.003 mm, and a gap is formed between the discharge valve core and the discharge valve seat.

19. The steam powered nailing gun according to claim 18, wherein the evacuation valve comprises an evacuation valve body, an evacuation valve core, and a compression spring, wherein the evacuation valve core is disposed inside the evacuation valve body, the compression spring is disposed on the evacuation valve core, and a sealing conical surface is disposed between the evacuation valve body and the evacuation valve core.

20. The steam powered nailing gun according to claim 19, wherein the guide sleeve has an upper external thread on an upper end of the guide sleeve, and a lower external thread on a lower end of the guide sleeve, the guide sleeve is disposed between the plunger and the adjustment knob, and the guide sleeve is connected to the adjustment knob through the upper external thread, and to the upper pump body through the lower external thread.

* * * * *